US006859952B2

(12) United States Patent
Perry

(10) Patent No.: US 6,859,952 B2
(45) Date of Patent: Mar. 1, 2005

(54) SPA COVER LIFTER APPARATUS AND METHOD

(76) Inventor: Gary L. Perry, 3325 W. Cedar Meadows La., Manhattan, MT (US) 59741

( * ) Notice: Subject to any disclaimer, the term of this patent is extended or adjusted under 35 U.S.C. 154(b) by 0 days.

(21) Appl. No.: 10/717,142

(22) Filed: Nov. 19, 2003

(65) Prior Publication Data

US 2004/0154090 A1 Aug. 12, 2004

Related U.S. Application Data

(60) Provisional application No. 60/428,573, filed on Nov. 22, 2002.

(51) Int. Cl.[7] ..... E04H 4/06
(52) U.S. Cl. ..... 4/498
(58) Field of Search ..... 4/498

(56) References Cited

U.S. PATENT DOCUMENTS

| | | | | |
|---|---|---|---|---|
| 4,853,985 | A | 8/1989 | Perry | |
| 4,857,374 | A | 8/1989 | Perry | |
| 4,991,238 | A | 2/1991 | Forrest | |
| 5,131,102 | A | 7/1992 | Salley et al. | |
| 5,471,685 | A | 12/1995 | Cross | |
| 5,517,703 | A | 5/1996 | Ouelette | |
| 5,566,403 | A | 10/1996 | Black et al. | |
| 5,584,081 | A | 12/1996 | Ouelette | |
| 5,634,218 | A | 6/1997 | Ouelette | |
| 5,644,803 | A | 7/1997 | Wilson | |
| 5,689,841 | A | 11/1997 | Black et al. | |
| 5,819,332 | A | 10/1998 | Perry | |
| 5,950,252 | A | 9/1999 | Fettes | |
| 5,974,599 | A | 11/1999 | Tudor | |
| 5,996,137 | A | 12/1999 | Genova | |
| 6,381,766 | B1 | 5/2002 | Perry | |
| 6,601,834 | B2 | 8/2003 | Perry | |
| 6,795,984 | B1 * | 9/2004 | Brady | 4/498 |

OTHER PUBLICATIONS

Aqua Magizine article, Jun. 1996 Issue, entitled "Rising to the Occasion" by Alan E. Sanderfoot.
Promotional information brochure by CEnTech Corporation.

* cited by examiner

*Primary Examiner*—Charles E. Phillips
(74) *Attorney, Agent, or Firm*—Law Offices William Forster

(57) ABSTRACT

A spa cover lifter comprising opposing left and right side arm supports spaced apart to receive opposing left and right cover side surfaces between the same. Each side arm support has an upper end adapted to rotatably support a portion of the spa cover and an opposing lower end. Each side arm support is rotatably mounted to a spa side. Extending from the right side arm support, around the back spa side, to the opposing left side arm support is a lower linking member having opposing ends spaced apart to pivotally attach to the respective spaced apart left and right side arm supports. The linking member can pivot relative to the side arms, about a substantially horizontal axis to define a linking member pivot angle which is the angle between each side arm support and the linking member. The pivotal attachment point of the lower linking member to the respective side arm support is adjacent the respective lower end thereof. To maintain the relative angle between each side arm support and the linking member, an adjustable bracing extends between each side arm support and the linking member. The relative position between each side arm support and the linking member is adjustable.

20 Claims, 5 Drawing Sheets

SPA COVER LIFTER APPARATUS AND METHOD

This application claims the benefit of U.S. Provisional Application No. 60/428,573 filed Oct. 22, 2002.

BACKGROUND

This invention relates generally to hot tubs and spas, and more particularly to removal systems adapted for lifting and removing spa covers therefrom.

Spa cover removal systems and mechanisms are known in the art. Such mechanisms vary widely in complexity, ease of operation and cost of manufacturing. In recent years, the rise in popularity of spas, commonly referred to as hot tubs, has hastened the development of spa covers and removal apparatus therefor. One early design for cover removal is disclosed in U.S. Pat. No. 4,857,374 issued to Perry (Gary L.) in 1989. The Perry design employs gas springs that extend from the sides of a spa to a spa cover that is hinged to the rear of the spa. In this way, the gas springs assist the user to pivot the cover to a vertical position, away from the top of the spa.

U.S. Pat. No. 4,853,985 issued to Perry (Cliff R.) in 1989 shows a cover assembly for use with a spa. The cover assembly includes a cover member mounted for rotational movement to the spa structure by mounting arms. The mounting arms are arranged relative to the cover member so that the cover member travels along a path from a covering position to an open position. Additionally, the '985 device includes tension springs. Because of the arrangement of the mounting arms and their attachment to the spa cover, the design is not easily adaptable for use with spa covers that fold back to expose only a portion of the spa.

U.S. Pat. No. 4,991,238 issued to Forrest in 1991 shows a spa cover lift that includes one or more struts for positioning a movable frame adapted for pivotable attachment to the side of a spa. The lift includes apparatus for receiving a spa cover from the spa and retaining the cover adjacent the movable frame. The struts are operable to displace the movable frame to an extended position to provide a surface onto which a spa user can slide a spa cover. Because the Forrest device requires that the entire spa cover be moved rearward onto the movable frame, a single user could find it difficult to slide a large heavy cover.

U.S. Pat. No. 5,131,102 issued to Salley in 1992 shows a device for use in conjunction with a spa cover mounted for pivotal movement to facilitate the removal of the cover away from the vicinity of the spa when the same is in use. A bridge arm supported by two side arms is pivotally attached to a base. The bridge arm can be pivoted into position adjacent the spa cover. With the spa cover folded over, the bridge arm is pivoted clearly away from the spa. The arrangement of the '102 device is such that it provides support to the spa cover only at the cover's folding point during the removal process. Accordingly, a portion of the cover slides over the spa as a user operates the device to remove the cover.

U.S. Pat. No. 5,471,685 issued to Cross in 1995 shows a support for a cover of a hot tub spa having a pair of roller support arms, each having a pivotal connection for securing it to the spa. The pivotal connections each comprise an attachment member for mounting on a vertical outer wall of the spa, with a hinge connecting the support arm to its attachment member for pivotal movement between operative and inoperative positions. Like the Forrest device, the entire spa cover must be moved rearward onto the frame.

U.S. Pat. No. 5,517,703 issued to Ouelette in 1996 shows a lifting mechanism for removing and restoring a hinged spa cover from a spa tub. Two tubular brackets are cojoined so that base members on the brackets are aligned parallel, adjacent to one end of the spa, and arms on the brackets extend along opposite sides of the spa. The cojoined base members are pivotally mounted so that the lifting arms are rotatable between a first lowered position and a second raised position. Support beams are connected to the lifting arms over which the hinged sections of the cover are foldable when the arms are in the first position allowing the cover to be lifted clear of the spa when the arms are moved to the second raised position. Like the Salley device, the '703 cover removal apparatus, during the removal process, provides support to the spa cover only at the cover's folding point.

U.S. Pat. No. 5,584,081 issued to Ouelette in 1996 shows a lifting frame for a hinged spa cover having a pair of adjustable lifting arms pivotally mounted adjacent the side walls of a spa. A U-shaped foot actuated lever is connected to the lifting arms with the base of the lever extended across one end wall of the spa. The upper part of the arms are equipped with one or more supports that are adjacent to and parallel with the cover hinge whereby the cover is foldable over the support or supports when the lifting arms are in a first position. The foot lever is elevated when the lifting arms are in the first position, and depressing the lever causes the arms to be rotated to a second position whereby the folded cover is supported in a vertical position adjacent one end wall of the spa. Like the earlier Ouelette invention, the spa cover is supported only at its folding point.

U.S. Pat. No. 5,634,218 issued to Ouelette in 1997 shows a lifting frame for a hinged spa cover having a pair of adjustable lifting arms pivotally mounted on or adjacent to a side wall of a spa. The upper part of the arms are equipped with one or more supports that are adjacent to and parallel with the cover hinge with the cover being foldable over the support or supports when the lifting arms are in a first horizontal position. Rotation of the frame causes the folded cover to be rotated to a second, vertical position adjacent one end wall of the spa. Similar to the other Ouelette devices, this design provides support to the spa cover only at its folding point.

U.S. Pat. No. 5,644,803 issued to Wilson in 1997 shows a spa support assembly that is provided with a plurality of support arms having upper and lower ends with the lower ends pivotally attached to an external surface of the spa side wall for pivotal rotation of the upper ends of the support arms through an arc from a point above and adjacent to the side wall to a point away from the side wall at a point where the upper ends of the support arms are within the generally horizontal plane defined by the top surfaces of the side walls and at a distance away from the side wall. Like the prior '238 and '685 patents, the Wilson device requires that the user slide the spa cover rearward over the spa during the removal process.

While most of the above noted designs assist in the removal process of a spa cover from a spa, they typically do not provide a simple, safe, inexpensive and adjustable means to remove and support the spa cover in a compact position which allows unimpeded access to the spa. Accordingly, a need remains for a spa cover removal apparatus that facilitates the easy removal of a spa cover by a single user which is safe, and easy to install and use.

SUMMARY OF THE INVENTION

One object of the present invention is reduce the effort required to remove a spa cover from a spa.

A second object is to facilitate the removal of a spa cover from a spa by only one person.

Another object is to protect expensive spa covers by simplifying the removal process thereof from a spa.

Yet another object is to reduce the expense of heating water in spas by promoting the use of spa covers that are easily removed by one person.

A further object is to increase the safety of using a cover removal apparatus.

Still another object is to fully support a spa cover in a compact manner thereby minimizing the space taken by the stowed cover following the removal process.

The invention is a spa cover lifter for assisting a person in the repositioning and removal of a spa cover from a spa. Typically, spa covers are constructed such that they include opposing left and right cover side surfaces. Additionally, spas are typically arranged to include a cabinet having a back spa side disposed between opposing left and right spa sides. Generally, such spas, and the cabinets thereof, are supported from a substantially flat supporting surface or floor.

In the present invention, the spa cover lifter comprises opposing left and right side arm supports spaced apart to receive opposing left and right cover side surfaces between the same. Each side arm support has an upper end adapted to rotatably support a portion of the spa cover, i.e., a portion of the respective cover side surface, and an opposing lower end. Importantly, each side arm support is rotatably mounted to a spa side. Specifically, the left side arm support is rotatably mounted to the left spa side, and the right side arm support is rotatably mounted to the right spa side. As will be discussed more fully in the following specification, the point of rotation of each side arm support, along the same, is disposed between the upper and lower ends thereof.

Extending from the right side arm support, around the back spa side, to the opposing left side arm support is a lower linking member having opposing ends spaced apart to pivotally attach to the respective spaced apart left and right side arm support. In this way, the linking member can pivot relative to the side arms, about a substantially horizontal axis to define a linking member pivot angle which is the angle between each side arm support and the linking member. In the preferred embodiment, the pivotal attachment point of the lower linking member to the respective side arm support is adjacent the respective lower end thereof.

In order to maintain the relative position or angle between each side arm support and the linking member, an adjustable bracing means extends between each side arm support and the linking member. In this way, the relative position between each side arm support and the linking member is adjustable. As will be seen in the following, the relative angle between the linking member and each side arm support is adjustable or selectable.

With this construction, the spa cover lifter is shiftable from a first position where the spa cover is in a horizontal covering position over the spa, to a second position where the spa cover is in a stowed position adjacent the back side of the spa as each side arm support rotates relative to the spa.

In another aspect of the invention, the degree of rotation of each side arm support is restricted by the action of the linking member engaging the substantially flat supporting surface or floor.

In another aspect of the invention, each adjustable bracing means is adjustable to selectively engage the respective side arm support at one of a plurality of points between the upper end and the lower end thereof.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

DETAILED DESCRIPTION OF PREFERRED EMBODIMENT

Figure 1:
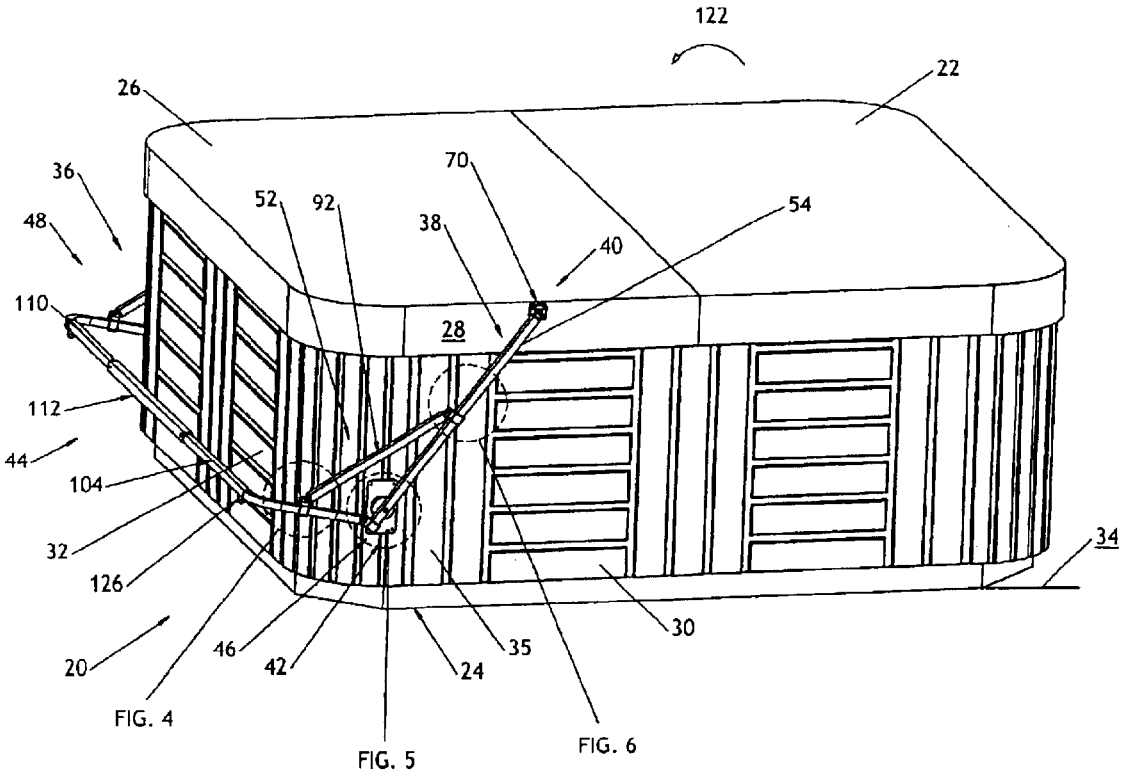
FIG. 1 is a rear perspective view of a spa cover lifter installed on a spa having a spa cover, wherein the spa cover lifter is in the first position where the spa cover is in the horizontal covering position over the spa.

FIGS. 1 through 8 show a preferred embodiment of a spa cover lifter 20. The spa cover lifter 20 is provided to assist a person in the repositioning and removal of a spa cover 22 from a spa 24. Typically, a spa cover 22 is constructed to include opposing left and right cover side surfaces 26 and 28. Additionally, spas are typically arranged to include a cabinet 30 having a back spa side 32 disposed between opposing left and right spa sides 33 and 35. Generally, such spas, and the cabinets thereof, are supported from a substantially flat supporting surface 34 or floor.

In the present invention, the spa cover lifter 20 is symmetrically constructed with the left side being a mirror image of the right side. Accordingly, only the components of the right side are discussed in detail and illustrated in the drawings. The spa cover lifter 20 comprises opposing left and right side arm supports 36–38 spaced apart to receive opposing left and right cover side surfaces 26–28 between the same. Each side arm support has an upper end 40 adapted to rotatably support a portion of the spa cover i.e., a respective portion of a cover side surface, and an opposing lower end 42. Importantly, each side arm support 36–38 is rotatably mounted to a spa side, i.e., the left side arm support 36 is rotatably mounted to the left spa side 33, and the right side arm support 38 is rotatably mounted to the right spa side 35. As will be discussed more fully in the following specification, the point of rotation of each side arm support is disposed between the upper end and the lower ends thereof.

Extending from the right side arm support 38 to the opposing left side arm support 36 is a lower linking member 44 having opposing ends 46–48 spaced apart to pivotally attach to the respective spaced apart left and right side arm supports 36–38. In the preferred embodiment, the pivotal attachment point of the lower linking member 44 to the respective side arm support is adjacent the respective lower end 42 thereof.

In order to maintain the relative position between each side arm support 36–38 and the linking member 44, an adjustable bracing means 52 extends between each side arm support 36–38 and the linking member 44. In this way, the relative position or angle between each side arm support 36–38 and the linking member 44 is adjustable. As will be seen in the following, the relative angle between the linking member 44 and each side arm support 36–38 is adjustable or selectable.

Figure 2:
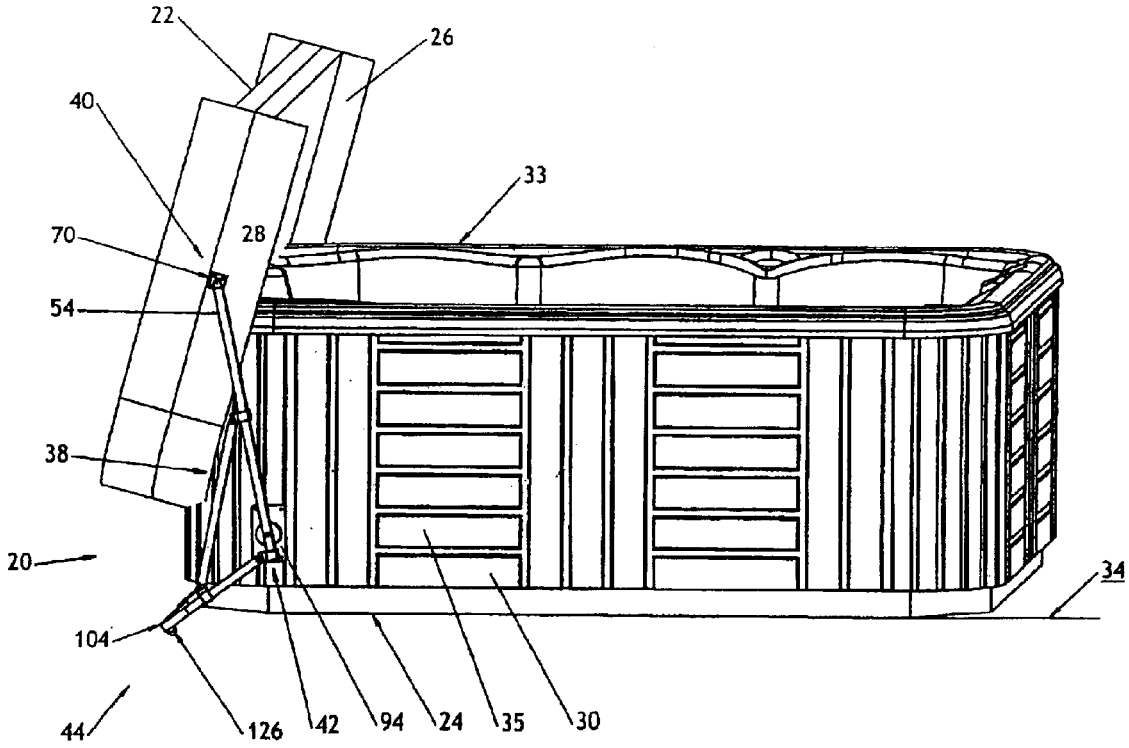
FIG. 2 is a perspective view of a spa cover lifter installed on a spa having a spa cover, wherein the spa cover lifer is shifted to a second supporting position to support the folded spa cover in a rearwardly disposed position.

With this construction, the spa cover lifter 20 is shiftable from a first position where the spa cover 22 is in a horizontal covering position over the spa 24 (FIG. 1), to a second position where the spa cover 22 is in a stowed position adjacent the back spa side 32 of the spa 24 as each side arm support 36–38 rotates relative to the spa 24 (FIG. 2).

Figure 3:
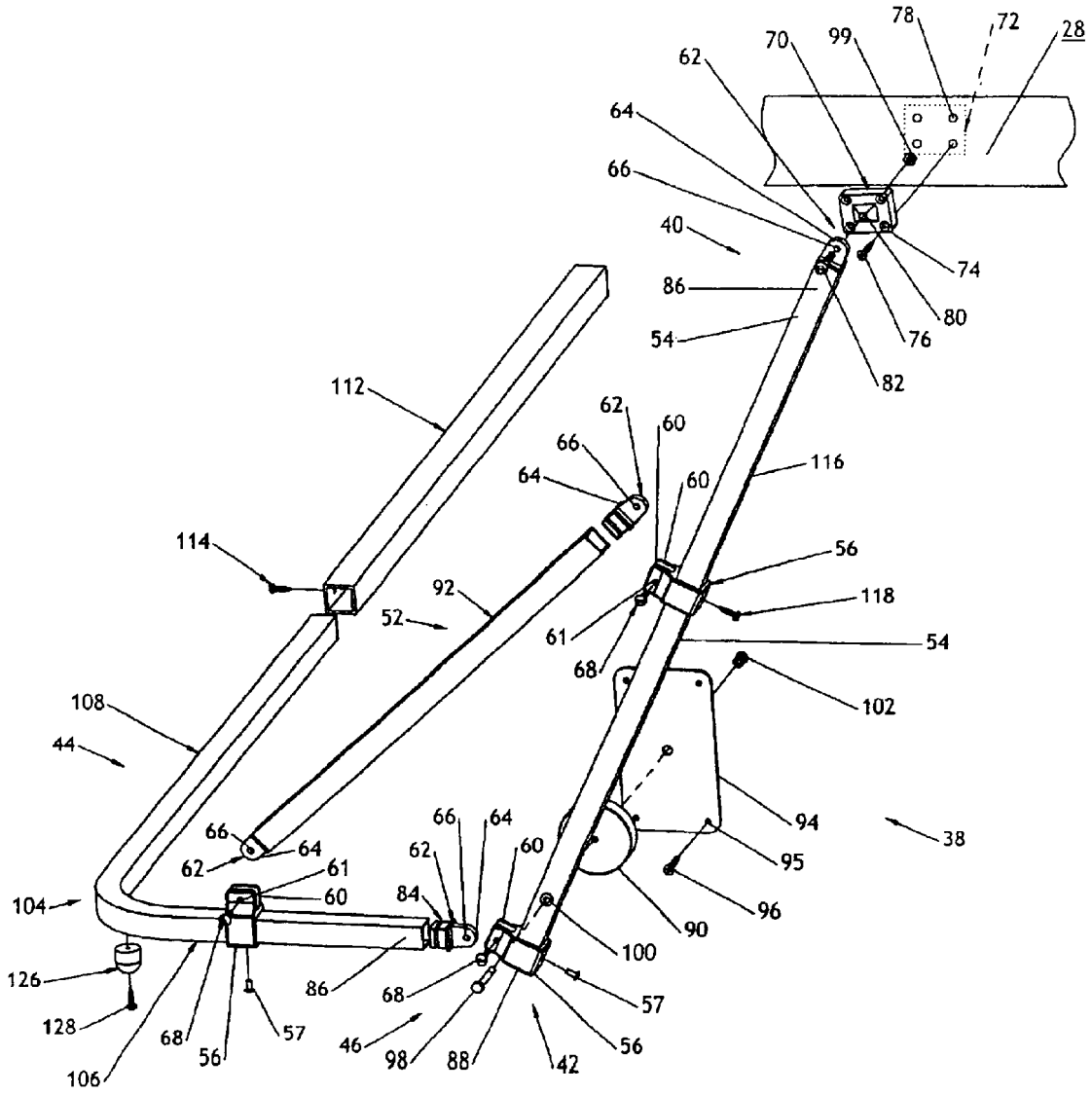
FIG. 3 is an exploded view of the right side of a spa cover lifter, wherein the left side (not illustrated) is constructed as a mirror image thereof.
Figure 4:
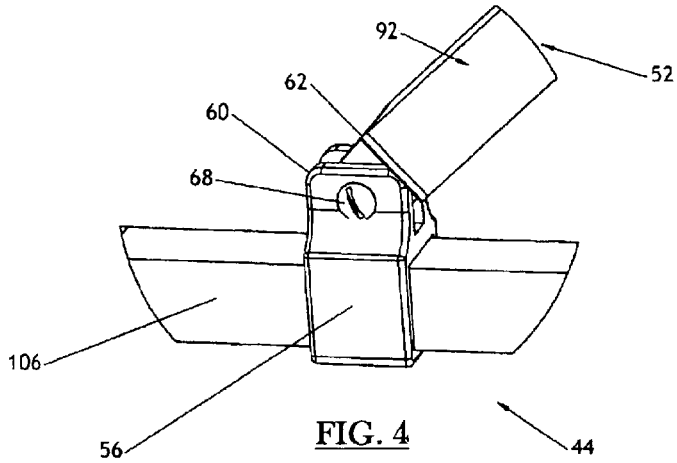
FIG. 4 is an enlarged fragmentary right side elevation view illustrating the connection between an adjustable bracing means and a linking member, the bracing means being provided to extend between a right side arm support and the linking member to maintain the relative position and angle between the linking member and the right side arm support.
Figure 5:
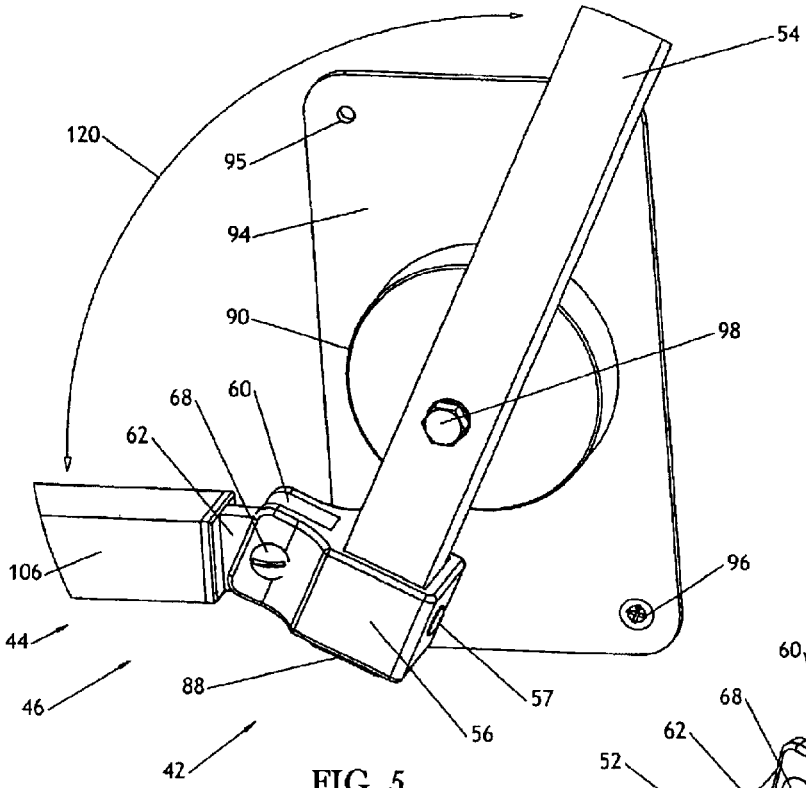
FIG. 5 is an enlarged fragmentary right side elevation view illustrating an end of a linking member pivotally attached to a right side arm support wherein the right side arm support is rotatingly attached to the right spa side.
Figure 6:
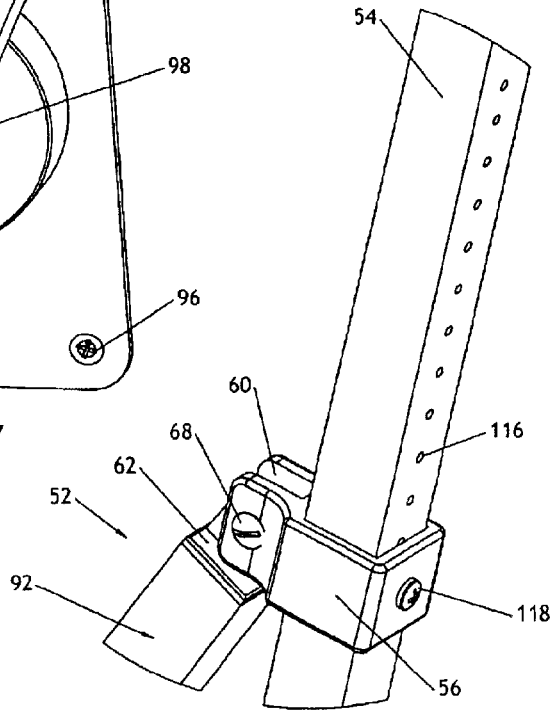
FIG. 6 is an enlarged fragmentary right side elevation view illustrating the connection between an adjustable bracing means and a right side arm support wherein the adjustable bracing means is a brace member provided to extend between a right side arm support and the linking member to maintain the relative position and angle between the linking member and the right side arm support.
Figure 7:
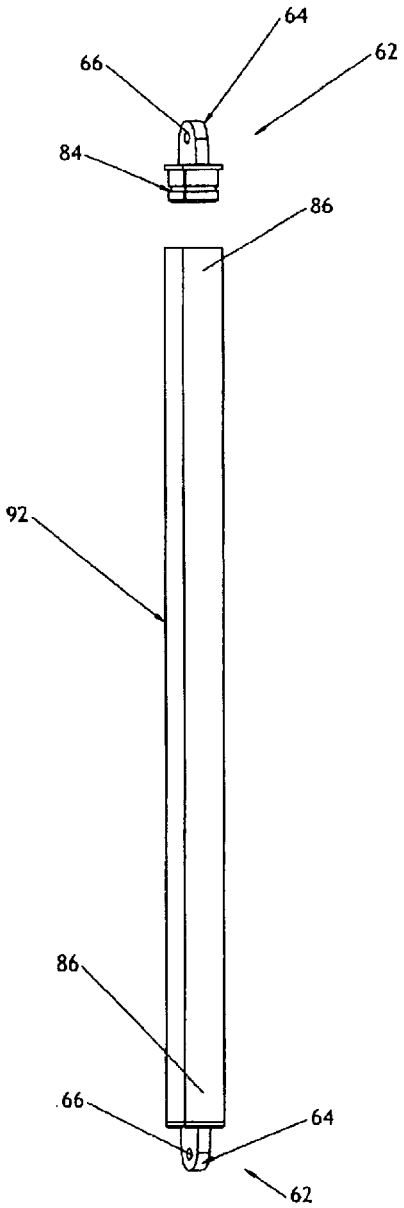
FIG. 7 is a perspective view illustrating the components of an adjustable bracing member.
Figure 8:
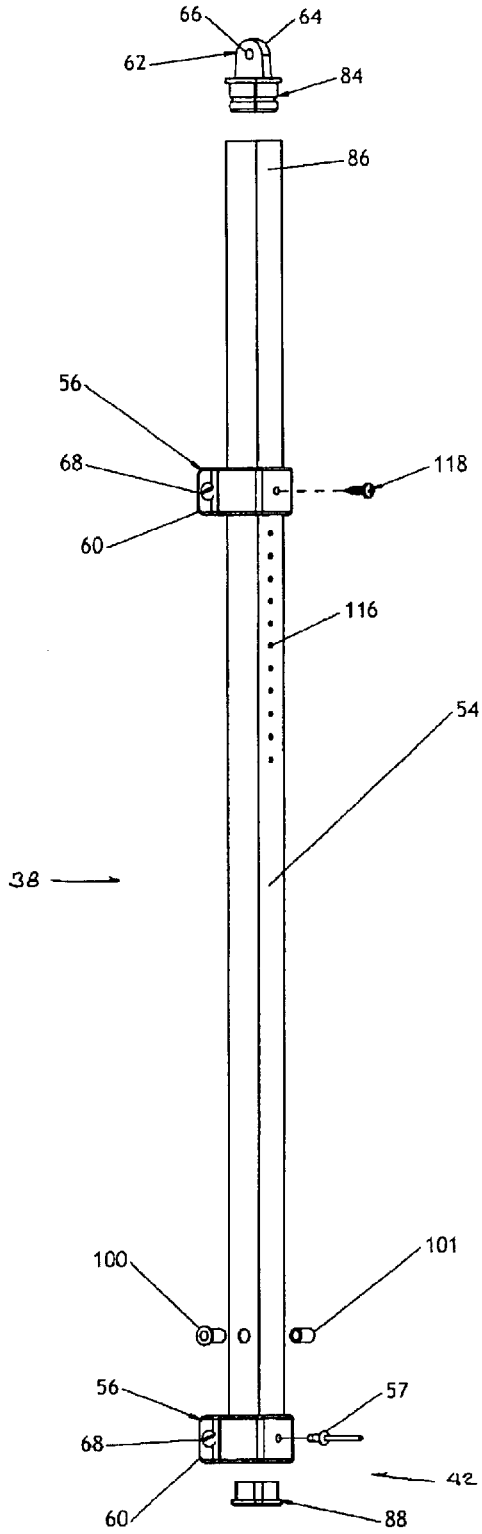
FIG. 8 is a perspective view of a side arm support with portions thereof exploded to further illustrate certain components.

Considering now in more detail the structure of the components from which a spa cover lifter 20 is constructed, a right side arm support 38 and the components thereof are best illustrated in FIGS. 3 and 8. In order to simplify construction and assembly, square tubing having a one-inch outside dimension is employed for most tubing in the present invention. Included in the right side arm support 38 is a tubular side arm 54 having two alike spaced jaw slides 56. Each jaw slide 56 is similarly constructed to encircle the tubular side arm 54 and conform closely to its tubular surface. Further, each jaw slide 56 is constructed to define two opposing receiving lugs 60, each with a bore 61 therethrough. The two opposing receiving lugs 60 are spaced to receive the pivot lug 64 of a connecting member.

Typically, connections in the present invention commonly employ an eye-end 62 having a pivot lug 64 which defines a bore 66 extending through the same. In this way, a typical connection is made by a pivot lug 64 received between receiving lugs 60 and joined by a jaw slide screw 68 screwed into the aligned bores 61 and 66. As will be discussed more fully below, the right side arm support 38 includes one jaw slide 56 for the connection of a brace member 92, and another alike jaw slide 56 for the connection of an end 46 of lower linking member 44.

Attachment of the right side arm support 38, and the side arm 54 thereof to the spa cabinet 30 is achieved by first securing a side hinge 70 to a pre-existing aluminum channel 72 disposed under the right cover side surface 28. The side hinge 70 includes 4 holes 74 through which 4 screws 76 are placed and tightened into 4 matching pre-existing holes 78 disposed in the aluminum channel 72. Importantly, the side hinge 70 is constructed to include a centrally disposed pivot bore 80 located in a central portion of the side hinge 70 which projects outward to "stand-off" from the right cover side surface 28. In this way, the bore 66 of eye end 62, can be aligned with pivot bore 80 so that a pivot screw 82 can pivotally join the eye end 62 to the spa cover 22 via the side hinge 70. Accordingly, side arm 54 pivots relative to the spa cover 22 through the pivot connection of its eye end 62 which is disposed at the upper end 40 of right side arm support 38.

Direction attention to FIG. 8, it should be noted that the eye end 62 includes a body portion 84 which is shaped to securely fit within the tubular side arm 54. In order to permanently fix the eye end 62 within side arm 54, crimping forces 86 are applied to the portion of the side arm 54 receiving the eye end 62. Importantly, all eye ends 62 employed in the present invention are similarly secured within a tubular member. Additionally, at the opposing end of side arm 54, i.e., the lower end 42 of the right side arm support 38, is an end cap 88 which is provided to enclose the end of tubular side arm 54.

Returning to FIG. 3, the pivotal connection of the side arm support 38 to the right spa side 35 of spa cabinet 30 is achieved by the pivotal connection of side arm 54 to pivot plate 94 which is secured to the spa by 4 screws 96. As a spacer, a pivot wheel 90 is disposed between the pivot plate 94 and the side arm 54. In this way, a bolt 98 can be inserted through two bushings 100 and 101 provided in the side arm 54 (also see FIG. 8). Further, the bolt 98 extends through pivot wheel 90 and is fastened to a threaded insert 102 fixed through the central portion of pivot plate 94. Accordingly, the side arm support 38 is pivotally supported from the spa cabinet 30.

As noted above, a jaw slide 56 is disposed at the lower end 42 of the right side arm support 38 as illustrated in FIG. 3, and is provided to pivotally connect the right end 46 of the lower linking member 44 to the right side arm support 38. Similarly, the left end 48 of the lower linking member 44 is pivotally connected to the "mirror image" left side arm support 36 (not illustrated).

The lower linking member 44 includes a right corner tube 104 which includes a 90 degree bend that defines a side portion 106 and a linking portion 108. The side portion 106 is disposed to extend substantially parallel to the right spa side 35 with the end 46 thereof having and eye end 62 attached and crimped within the tubular side portion 106 as noted above. The linking portion 108 extends substantially parallel to the back spa side 32 and is connected to a similarly constructed "mirror-image" left corner tube 110 by a centrally disposed connecting tube 112 which has a slightly larger cross section. The connecting tube 112 is sized to securely fit over both the left and right corner tubes 110 and 104, and overlaps each so that a fastener 114 can secure the members together.

Turning again to FIGS. 1 through 3, and as noted above, an adjustable bracing means 52 is provided to adjustably brace at least one side arm support 38 from the lower linking member 44. For example, in the present invention, a brace member 92, fitted with two eye ends 62 (one at each end), to extend from a jaw slide 56 disposed on the side portion 106 of the right corner tube 104. The brace member 92 extends to the side arm 54 of the right side arm support 38. Similarly, a jaw slide 56 is disposed on the side arm 54, as illustrated, to complete the pivotal connection with the eye end 62 of the brace member 92. Further, a plurality of predetermined bores 116 (see FIGS. 6 and 7) are provided through one surface of the side arm 54 so that the jaw slide 56 can be fixed at multiple locations along the side arm 54 by a fastener 118. In this way, the angle designated by numeral 120 between the side portion 106, of the lower linking member 44, and the side arm 54 can be selected and adjusted according to the size and configuration of the spa 24.

Accordingly, when the spa cover 22 is folded as noted in FIG. 2 by arrow 122, the spa cover 22, and the spa cover lifter 20 shifts from a first position, where the spa cover. 22 is in a horizontal covering position over the spa 24, as illustrated in FIG. 1, to a second position, as illustrated in FIG. 2, where the spa cover 22 is in a stowed position adjacent the back side of the spa 24 as each left and right side arm support 36 and 38 rotates relative to the spa 22.

Notably, as seen in FIG. 2, the lower linking member 44, and rubber bumpers 126 disposed thereon, attached by screw 128, contact the floor, i.e., the supporting surface 34. As can be seen, the ability to adjust the position of the brace member 92, in relation to the side arm 54, controls the position of the spa cover 22 over the spa cover lifter 20 when the same in the second position. In this way, the spa cover 22 can be properly balanced over the spa cover lifter 20. Additionally, it should be understood that the preferred embodiment includes a similarly constructed "mirror immage" adjustable bracing means (not illustrated) between the left side arm support 36 and the lower linking member 44.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A spa cover lifter for assisting in the repositioning and removal of a spa cover having opposing left and right cover side surfaces, from a spa of the type supported from a substantially flat supporting surface, and having a back spa side disposed between opposing left and right spa sides, the spa cover lifter comprising:

opposing left and right side arm supports spaced apart to receive opposing cover side surfaces between the same, each side arm support having an upper end adapted to rotatably support a portion of the spa cover, and an opposing lower end, wherein the left side arm support is rotatably mounted to the left spa side and the right side arm support is rotatably mounted to the right spa side;

a lower linking member having spaced apart opposing ends, the lower linking member being shaped to extend from one side arm support, around the back spa side, to the opposing side arm support with each end of the linking member being pivotally attached to a respective side arm support to enable the linking member to pivot about a substantially horizontal axis, relative to the side arms, to define a linking member pivot angle between each side arm support and the linking member;

means for adjustably bracing each side arm support from the linking member to fix the linking member pivot angle; and wherein the spa cover lifter is shiftable from a first position where the spa cover is in a horizontal covering position over the spa, to a second position where the spa cover is in a stowed position adjacent the back spa side of the spa as each side arm support rotates relative to the spa.

2. A spa cover lifter as recited in claim 1 wherein the linking member pivot angle is selectable to a plurality of predetermined angles.

3. A spa cover lifter as recited in claim 2 wherein the degree of rotation of each side arm support is restricted by the linking member engaging the substantially flat supporting surface as the spa cover lifter is shifted from the first position to the second position.

4. A spa cover lifter as recited in claim 1 wherein the degree of rotation of each side arm support is restricted by the linking member engaging the substantially flat supporting surface as the spa cover lifter is shifted from the first position to the second position.

5. A spa cover lifter as recited in claim 1 wherein the degree of rotation of each side arm support is restricted by the linking member engaging the back spa side as the spa cover lifter is shifted from the first position to the second position.

6. A spa cover lifter as recited in claim 1 wherein the lower linking member comprises opposing side portions, disposed adjacent the ends of the lower linking member, that are substantially parallel to the respective spa side, wherein each bracing means extends from the respective side portion, to the respective side arm support.

7. A spa cover lifter as recited in claim 1 wherein each pivotal connection between the opposing ends of the linking member and the respective side arm support occurs at a point between the upper end and the lower end of the respective side arm.

8. A spa cover lifter as recited in claim 1 wherein the each pivot connection between the opposing ends of the linking member and the respective side arm support occurs at the lower end of the respective side arm support.

9. A spa cover lifter as recited in claim 1 wherein the bracing means comprises a pair of structural members, wherein one structural member is fixed to each side arm support at a point between the upper and lower end thereof, with each respective structural member extending to and being fixed to the lower linking member.

10. A method of making a spa cover lifter for assisting in the repositioning and removal of a spa cover having opposing left and right cover side surfaces, from a spa of the type supported from a substantially flat supporting surface, and having a back spa side disposed between opposing left and right spa sides, the method comprising the steps:

providing opposing left and right side arm supports and spacing them apart to receive opposing cover side surfaces between the same, each side arm support having an upper end adapted to rotatably support a portion of the spa cover, and an opposing lower end, wherein the left side arm support is rotatably mounted to the left spa side and the right side arm support is rotatably mounted to the right spa side;

connecting a lower linking member to opposing left and right side arm supports, the a lower linking member having spaced apart opposing ends, the lower linking member being shaped to extend from one side arm support, around the back spa side, to the opposing side arm support with each end of the linking member being pivotally attached to a respective side arm support to enable the linking member to pivot about a substantially horizontal axis, relative to the side arms, to define a linking member pivot angle between each side arm support and the linking member;

adjustably bracing each side arm support from the linking member to fix the linking member pivot angle; and wherein the spa cover lifter is shiftable from a first position where the spa cover is in a horizontal covering position over the spa, to a second position where the spa cover is in a stowed position adjacent the back spa side of the spa as each side arm support rotates relative to the spa.

11. A method for making a spa cover lifter as recited in claim 10 wherein the linking member pivot angle is selectable to a plurality of predetermined angles.

12. A method for making a spa cover lifter as recited in claim 11 wherein the degree of rotation of each side arm support is restricted by the linking member engaging the substantially flat supporting surface as the spa cover lifter is shifted from the first position to the second position.

13. A method for making a spa cover lifter as recited in claim 10 wherein the degree of rotation of each side arm support is restricted by the linking member engaging the substantially flat supporting surface as the spa cover lifter is shifted from the first position to the second position.

14. A method for making a spa cover lifter as recited in claim 10 wherein the degree of rotation of each side arm support is restricted by the linking member engaging the back spa side as the spa cover lifter is shifted from the first position to the second position.

15. A method for making a spa cover lifter as recited in claim 10 wherein the length of each side arm is predetermined and fixed.

16. A method for making a spa cover lifter as recited in claim 10 wherein each pivotal connection between the opposing ends of the linking member and the respective side arm support occurs at a point between the upper end and the lower end of the respective side arm.

17. A method for making a spa cover lifter as recited in claim 10 wherein the each pivot connection between the opposing ends of the linking member and the respective side arm support occurs at the lower end of the respective side arm support.

18. A spa cover lifter for assisting in the repositioning and removal of a spa cover having opposing left and right cover side surfaces, from a spa of the type supported from a substantially flat supporting surface, and having a back spa side disposed between opposing left and right spa sides, the spa cover lifter comprising:

opposing left and right side arm supports spaced apart to receive opposing cover side surfaces between the same, each side arm support having an upper end adapted to rotatably support a cover side surface, and an opposing lower end, wherein the left side arm support is rotatably mounted to the left spa side and the right side arm support is rotatably mounted to the right spa side;

a lower linking member having spaced apart opposing ends, the lower linking member being shaped to extend from one side arm support, around the back spa side, to the opposing side arm support with each end of the linking member being pivotally attached to a respective side arm support to enable the linking member to pivot about a substantially horizontal axis, relative to the side arms, to define a linking member pivot angle between each side arm support and the linking member;

a pair of brace members for adjustably bracing each side arm support from the linking member to fix the linking member pivot angle, wherein one brace member is adjustably fixed to each side arm support at a point between the upper and lower end thereof, with each respective brace member extending to and being fixed to the lower linking member, wherein the point of connection between each brace member to the respective side arm support is adjustable along the side arm support so that the linking member pivot angle is selectable between a plurality of angles; and wherein the spa cover lifter is shiftable from a first position where the spa cover is in a horizontal covering position over the spa, to a second position where the spa cover is in a stowed position adjacent the back spa side of the spa as each side arm support rotates relative to the spa.

19. A spa cover lifter as recited in claim 18 wherein each side arm support comprises side arm member and a movable jaw slide that is movable along the side arm member, wherein the jaw slide provides the a pivotal point of attachment between the brace member and the respective side arm support.

20. A spa cover lifter as recited in claim 19 wherein the side arm member defines a plurality of bores for engagement with a fastener disposed through the movable jaw slide, wherein the jaw slide can be fixed along the side arm at predetermined points determined by the position of the bores.

* * * * *